US007755568B2

(12) United States Patent
You

(10) Patent No.: US 7,755,568 B2
(45) Date of Patent: Jul. 13, 2010

(54) VIDEO MUTING DEVICE FOR DIGITAL VIDEO SIGNAL AND MUTING METHOD THEREFOR

(75) Inventor: Chul-ho You, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1178 days.

(21) Appl. No.: 11/033,254

(22) Filed: Jan. 12, 2005

(65) Prior Publication Data

US 2005/0151713 A1 Jul. 14, 2005

(30) Foreign Application Priority Data

Jan. 13, 2004 (KR) ..... 10-2004-0002157

(51) Int. Cl.
*G09G 5/00* (2006.01)

(52) U.S. Cl. ..... 345/3.1; 345/3.2; 345/3.3; 345/3.4; 345/98; 345/99; 345/100

(58) Field of Classification Search ..... 345/3.1–3.4, 345/98–100
See application file for complete search history.

(56) References Cited

U.S. PATENT DOCUMENTS 6,353,459 B1 * 3/2002 Yeh et al. ..... 348/441
2002/0145597 A1 * 10/2002 Kim ..... 345/204

FOREIGN PATENT DOCUMENTS

| | | |
|---|---|---|
| JP | 7-115598 | 5/1995 |
| JP | 7-140434 | 6/1995 |
| JP | 9-135395 | 5/1997 |
| KR | 1993-19105 | 9/1993 |
| KR | 1998-8802 | 3/1998 |
| KR | 1998-13068 | 4/1998 |
| KR | 1999-45473 | 10/1999 |

* cited by examiner

*Primary Examiner*—Richard Hjerpe
*Assistant Examiner*—Leonid Shapiro
(74) *Attorney, Agent, or Firm*—Staas & Halsey LLP

(57) ABSTRACT

A video muting device for a digital video signal, and a video muting method thereof. The video muting device includes a scaler which determines according to a clock (CLK) signal of an inputted digital video signal whether a mode has changed, and generates an interrupt signal if the mode has changed, and a control part which generates a mute signal upon being input with the interrupt signal from the scaler. Accordingly, even when a digital signal, as well as an analog signal, is input, transient phenomena and noise generated during mode change can be effectively removed.

14 Claims, 3 Drawing Sheets

VIDEO MUTING DEVICE FOR DIGITAL VIDEO SIGNAL AND MUTING METHOD THEREFOR

CROSS-REFERENCE TO RELATED APPLICATIONS

This application claims the benefit of Korean Application No. 2004-2157, filed Jan. 13, 2004, in the Korean Intellectual Property Office, the disclosure of which is incorporated herein by reference.

BACKGROUND OF THE INVENTION

1. Field of the Invention

The present invention relates to a display device. More particularly, the present invention relates to a video muting device of a display device, for preventing transient phenomena generated when changing an operation mode, and a muting method thereof.

2. Description of the Related Art

General display devices such as monitors include video muting devices to prevent transient phenomena and noise from being displayed on a screen, with the transient phenomena or noise being generated while operation modes are being changed, for example, when turning on/off the power, changing sub-modes, and entering a dynamic power management (DPM) mode.

FIG. 1 shows a schematic block diagram of the video muting device provided in a conventional display device. As shown in FIG. 1, the video muting device includes a scaler 10 for converting an input signal into a predetermined resolution, and a control part 30 for determining whether a mode of the display is changed and generating a mute signal. The control part 30 determines the mode change according to a type of signal input to the display device.

An analog video signal, including a red-green-blue (RGB) signal, and horizontal-synchronization (H-sync) and vertical-synchronization (V-sync) signals is input to the scaler 10. The RGB signal input to the scaler 10 is processed by an analog-digital converter (ADC), a phase lock loop (PLL), scaled, based on the H-sync and V-sync signals, and output. The H-sync and V-sync signals are input to the control part 30, and the control part 30 determines the resolution and change of modes based on the H-sync and V-sync signals. More specifically, when any of the H-sync and V-sync signals do not exist, the control part 30 determines the changed mode of the display and generates a mute signal.

A digital video signal which has the RGB signal and a clock (CLK) signal is input to the scaler 10. The scaler 10 counts the CLK signal to calculate horizontal-total (H-total) and vertical-total (V-total) and store them to a predetermined register. The control part 30 determines the resolution and change of modes based on the H-total and V-total stored to the register. In other words, the control part 30 reads the register value and compares the value with a table of the H-total and V-total according to different modes, as well as applicable resolution conversions, provided in the control part 30, thereby determining the modes and a change of modes. When the register value is changed, the control part 30 identifies the mode as having been changed and generates the mute signal.

As can be appreciated from the above description, in the conventional case, the analog signal, the H-sync and V-sync signals are directly input to the control part 30 to determine whether the mode has changed. However, when a digital signal is input, the scaler 10 first counts the CLK to obtain the H-total and V-total, and then the control part 30 reads and compares the H-total and V-total so as to determine whether the mode has changed. Accordingly, a mode change determination takes longer with the digital signal, compared to the analog signal.

Thus, in a conventional muting system for a digital signal, as described above, the control part 30 identifies a change in the H-total and V-total from the moment that they are changed. Therefore, during the time when the H-total and V-total change, until when the control part identifies the change and generates the mute signal, the transient phenomena and noise can not be removed.

SUMMARY OF THE INVENTION

An aspect of the present invention is to solve at least the above problems and/or disadvantages and to provide at least the advantages described below. Accordingly, an aspect of the present invention is to provide a video muting device capable of generating a high speed mute signal when a mode of a digital video signal changes, in order to prevent transient phenomena, and a method therefor.

Additional aspects and/or advantages of the invention will be set forth in part in the description which follows and, in part, will be obvious from the description, or may be learned by practice of the invention.

To achieve the above and/or other aspects and advantages, embodiments of the present invention set forth a video muting device for removing transient phenomena and noise, including a scaler to determine, according to a clock (CLK) signal of an input digital video signal, whether a mode of a display device changes, and to generate an interrupt signal if the mode changes, and a control part to generate a mute signal upon receipt of the interrupt signal from the scaler.

In addition, the scaler may count the CLK signal to calculate horizontal-total (H-total) and vertical-total (V-total), and generate the interrupt signal when a current H-total and V-total are determined to be different from a previous H-total and V-total.

Further, the control part may determine whether horizontal and vertical synchronization signals of an input analog video signal are input, and accordingly generate the mute signal if a mode change of the analog video signal is detected.

The video muting may include a parallel-serial conversion part to convert a video signal output from the scaler into a serial signal, a display panel to externally display the converted video signal, a lamp control part to control lighting of a fluorescent lamp of the display panel, and a power supply part to supply driving power to the display device, wherein the mute signal controls driving of the parallel-serial conversion part, the display panel, and/or the lamp control part.

To achieve the above and/or other aspects and advantages, embodiments of the present invention set forth a video muting method for removing transient phenomena and noise, including determining whether a display mode of a display changes based on a clock (CLK) signal of an input digital video signal, and generates an interrupt signal if the mode changes, and generating a mute signal to mute the display device upon receipt of the interrupt signal.

The determining of whether the display mode has changed may include counting the CLK signal to calculate an H-total and a V-total and generating the interrupt signal when a current H-total and a current V-total are different from a previous H-total and a previous V-total.

The method may further include determining whether horizontal and vertical synchronization signals of an input analog signal are input, and accordingly generating the mute signal if a change in modes of the display device is detected.

To achieve the above and/or other aspects and advantages, embodiments of the present invention set forth a video muting device for removing transient phenomena and noise, including a scaler to perform scaling control of input video signals, including an input analog video signal and an input digital video signal, for display on in display system, to count a clock (CLK) signal of the input digital video signal to calculate horizontal-total (H-total) and vertical-total (V-total), indicating whether a mode of the input digital video signal changes, and to generate an interrupt signal if the mode changes, and a control part to determine whether horizontal and vertical synchronization signals of the input analog video signal are input, and to generate a mute signal if mode changes of the digital video signal and/or analog video signal are detected, with the mode change of the digital video signal being indicated to the control part by the scaler generated interrupt signal.

The change of mode of the input digital video signal may be determined when a current H-total and/or V-total is determined to be different from a previous H-total and/or V-total.

To achieve the above and/or other aspects and advantages, embodiments of the present invention set forth a display system, including a video muting embodiment of the present invention, a parallel-serial conversion part to convert a video signal output from the scaler into a serial signal, a display panel to externally display the converted video signal, a lamp control part to control lighting of a fluorescent lamp of the display panel, and a power supply part to supply driving power to the display device, wherein the mute signal controls driving of the parallel-serial conversion part, the display panel, and/or the lamp control part.

To achieve the above and/or other aspects and advantages, embodiments of the present invention set forth a video muting method for removing transient phenomena and noise, including performing scaling in a scaler control of input video signals, including an input analog video signal and an input digital video signal, for display on in display system, including counting a clock (CLK) signal of the input digital video signal to calculate horizontal-total (H-total) and vertical-total (V-total), and generating in the scaler an interrupt signal indicating whether a mode of the input digital video signal changes, determining whether horizontal and vertical synchronization signals of the input analog video signal are input, in a control part separate from the scaler, and generating a mute signal if mode changes of the digital video signal and/or analog video signal are detected, with the mode change of the digital video signal being indicated to the control part by the scaler generated interrupt signal.

The change of mode of the input digital video signal may be determined when a current H-total and/or V-total is determined to be different from a previous H-total and/or V-total.

To achieve the above and/or other aspects and advantages, embodiments of the present invention set forth a display method, including a video muting method embodiment of the present invention, parallel-serial converting a video signal output from the scaler into a serial signal, displaying the converted video signal on a display, illumination controlling to control an illumination of the display I, and wherein the mute signal controls operation of the parallel-serial converting, the displaying of the converted videoon the display, and/or the illumination controlling.

To achieve the above and/or other aspects and advantages, embodiments of the present invention set forth a display system, including a scaler to perform scaling control of an input video signal, a display to display a scaler controlled output video signal, with the scaler outputting an interrupt signal based upon a determination, according to a clock (CLK) signal of an input digital video signal, whether a mode of a display device changes, and to generate an interrupt signal if the mode changes, and a control part to generate a mute signal controlling illumination of the display based upon the generated interrupt signal from the scaler and/or whether a mode change of an input analog video signal is detected.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
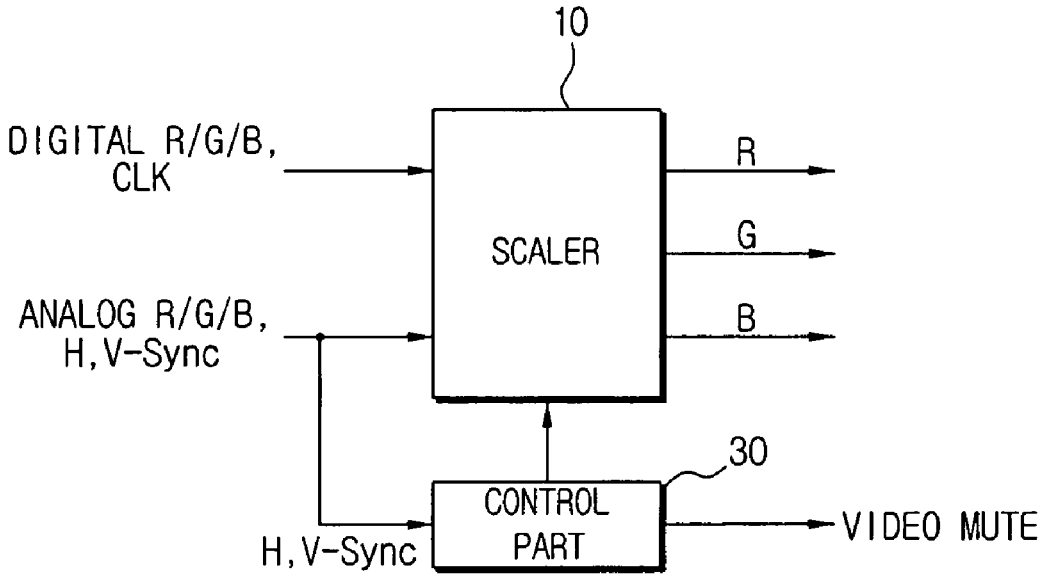
FIG. 1 (PRIOR ART)
FIG. 1 is a schematic block diagram illustrating a conventional video muting system/method.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
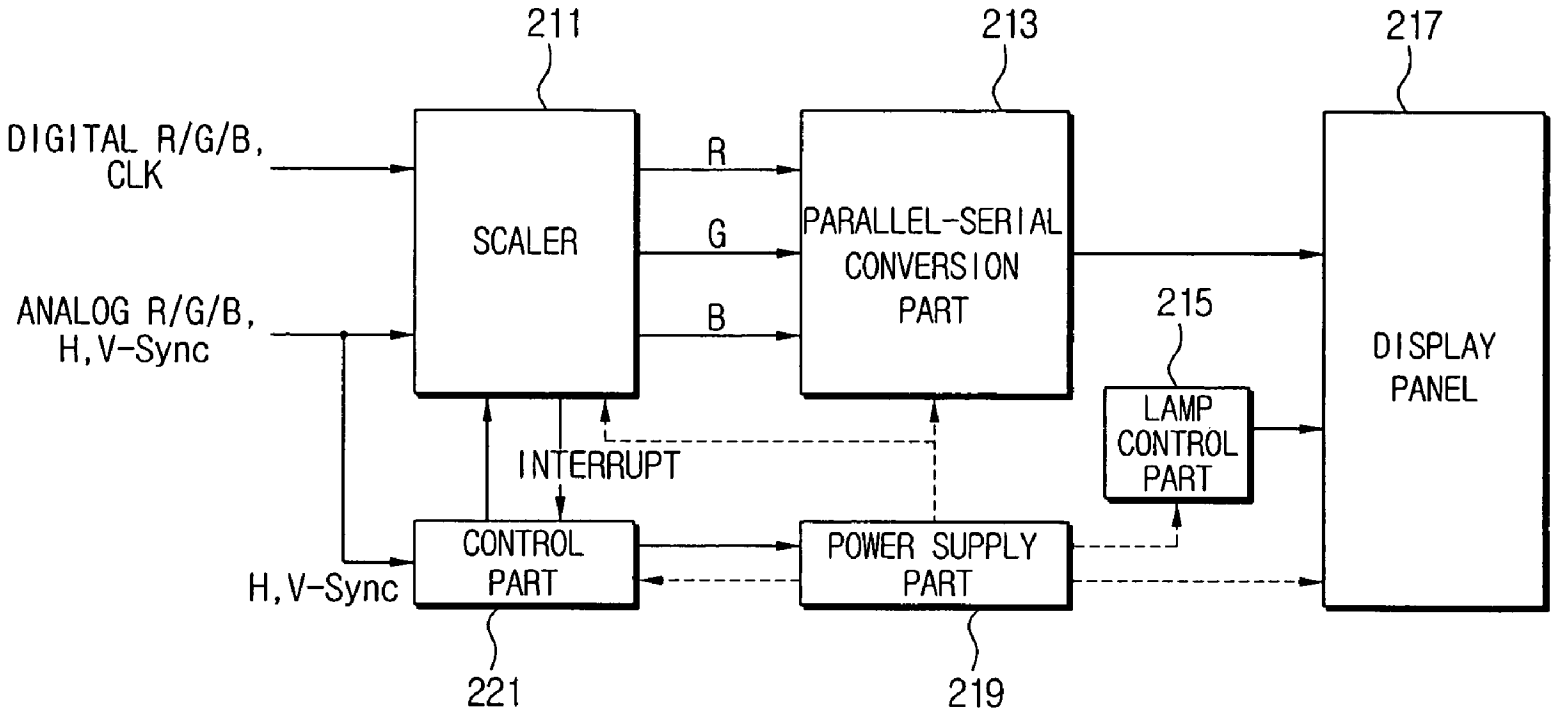
FIG. 2 is a block diagram of a video muting device, according to an embodiment of the present invention.

FIG. 2 is a schematic block diagram showing a video muting device provided in a display device, according to an embodiment of the present invention.

The video muting device may include a scaler 211, a parallel-serial conversion part 213, a lamp control part 215, a display panel 217, a power supply part 219, and a control part 221. As discussed further below, the video muting device can accordingly be incorporated into a display system as shown in later discussed FIG. 3.

As illustrated in FIG. 2, the scaler 211 converts a resolution of an input video signal to a predetermined resolution. If the input signal is an analog video signal having a red-green-blue (RGB) signal and horizontal-synchronization (H-sync) and vertical-synchronization (V-sync) signals, the scaler 211 processes the input signal by an analog-digital converter (ADC), a phase lock loop (PLL), and scaling based on the H-sync and V-sync signals.

If a digital video signal having the RGB signal and a clock (CLK) signal is input, the scaler 211 counts the CLK signal, a synchronization signal, to obtain horizontal-total (H-total) and vertical-total (V-total), and stores the H-total and V-total to a predetermined register. When the H-total and V-total change, the scaler 211 generates an interrupt signal to the control part 221 to identify that the mode of the digital signal has changed.

The parallel-serial conversion part 213 converts the RGB signal of a digital form, output in parallel from the scaler 211, to a serial signal, and transmits the signal to the display panel 217. Generally, a low voltage differential signal (LVDS) method is applied for interface between the parallel-serial conversion part 213 and the display panel 217.

The lamp control part 215 controls lighting of a fluorescent lamp disposed on a rear of the display panel 217, thereby generating high voltage of approximately 1500V to 2000V.

The display panel 217 may have a display element such as a liquid crystal display (LCD).

The power supply part 219 supplies electric power to respective components of the device according to a predetermined control signal. In general, a switching mode power signal (SMPS) device is used for the power supply part 219, to adjust the power supply by switching on/off predetermined power input.

The control part 221 controls the operation of the overall system, and also determines whether an input mode has changed to generate a video mute signal, according to an embodiment of the present invention.

More specifically, in the case of a digital signal, upon being input with the interrupt signal from the scaler 211, the control part 221 generates a mute signal (hereinbelow, referred to as a 'fast mute signal'), and in the case of an analog signal, when there is no H-sync and V-sync signals input, the control part 221 generates a mute signal (hereinbelow, referred to as a 'normal mute signal'), as in the conventional video muting device, for example.

The mute signal is a combination of a power-off signal for the display panel 217, a power-off signal for the fluorescent lamp, and an LVDS operation control signal. For example, the control part 221 may control the power supply part 219 to break a driving power of the lamp control part 215 and the display panel 217 and disable the parallel-serial conversion part 213. The video mute is generally performed by switching off the fluorescent lamp, the display panel, and the LVDS, in order. Releasing of the video mute can be similarly performed by switching on the LVDS, the display panel, and the fluorescent lamp, in order.

Accordingly, transient phenomena and noise displayed on the display panel when a mode is changed, or during conversion of the input display signal for display on the display panel, can be prevented.

Figure 3:
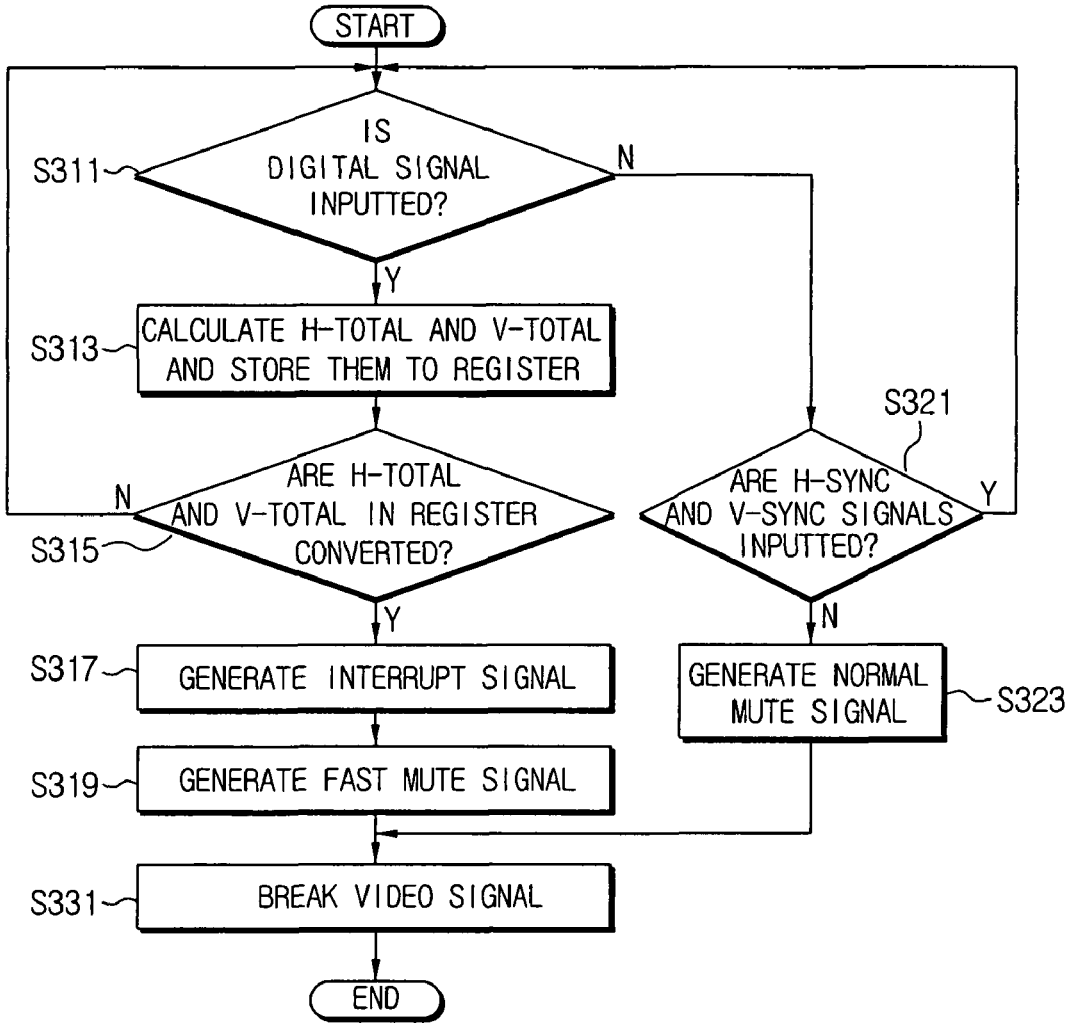
FIG. 3 a flowchart of a video muting method, according to an embodiment of the present invention.

FIG. 3 illustrates video muting operations for a display device, according to an embodiment of the present invention.

As illustrated in FIG. 3, the control part 221 controls overall operation of the system, and accordingly determines whether a signal input to the display device is a digital video signal or an analog video signal.

When a digital video signal is input (S311), the control part 221 determines whether an interrupt signal is input from the scaler 211, to determine a change of the display mode.

When the digital signal, such as the RGB signal and the CLK signal, is input, the scaler 211 counts the CLK to calculate the H-total and V-total, and stores them to a predetermined register (S313). At this time, the scaler 211 determines whether the H-total and V-total in the register have changed (S315). If the H-total and V-total have changed, the scaler 211 generates the interrupt signal to the control part 221 (S317).

The control part 221 generates a fast mute signal according to the input interrupt signal (S319).

Accordingly, the video signal is muted at the same moment of change of the H-total and V-total, detected in the scaler 211, and therefore, the transient phenomena can be prevented, compared to the conventional method where the transient phenomena is caused by a time delay from when the mode change is identified to when the mute signal is actually generated.

On the other hand, if an analog RGB signal is input (S311), the control part 221 checks whether the H-sync and V-sync signals of the analog signal is input, or whether they have changed, to determine a change in the mode. If any of the H-sync and V-sync signals are not input, or change, the control part 221 identifies this fact and generates the normal mute signal (S323).

In essence, the control part 221 generates the fast mute signal when the digital signal is input, and generates the normal mute signal when the analog signal is input. Therefore, the transient phenomena and noise output to the display panel 217 can be prevented (S331).

The mute signal generated by the control part 221 can be a combination of a power-off signal of the display panel 217, a power-off signal of the fluorescent lamp, and an LVDS operation control signal. For example, the control part 221 may control the power supply part 219 to break a driving power of the lamp control part 215 and the display panel 217 and disable the parallel-serial conversion part 213.

Accordingly, even when a digital signal or an analog signal are input to a display device, transient phenomena and noise generated during mode changes can be effectively removed.

Since the normal mute or the fast mute signals are generated for mode change, corresponding to the form of the input signal, removal of the transient phenomena and noise can be adaptively performed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A video muting device for removing transient phenomena and noise, comprising:

a scaler to determine, according to a clock (CLK) signal of an input digital video signal, whether a mode of a display device changes, and to generate an interrupt signal if the mode changes; and a control part to selectively generate a first mute signal upon receipt of the interrupt signal from the scaler when the scaler determines a mode change of the digital video signal when the digital video signal is input and a second mute signal when an analog video signal is input to the control part and the control part determines a mode change of the analog video signal.

2. The video muting device of claim 1, wherein the scaler counts the CLK signal to calculate horizontal-total (H-total) and vertical-total (V-total), and generates the interrupt signal when a current H-total and V-total are determined to be different from a previous H-total and V-total.

3. The video muting device of claim 1, wherein the control part determines whether horizontal and vertical synchronization signals of an input analog video signal are input, and accordingly generates the mute signal if a mode change of the analog video signal is detected.

4. The video muting device of claim 1, further comprising:

a parallel-serial conversion part to convert a video signal output from the scaler into a serial signal;

a display panel to externally display the converted video signal;

a lamp control part to control lighting of a fluorescent lamp of the display panel; and a power supply part to supply driving power to the display device, wherein the mute signal controls driving of the parallel-serial conversion part, the display panel, and/or the lamp control part.

5. A video muting method for removing transient phenomena and noise, comprising:

determining, at a scaler, whether a display mode of a display changes based on a clock (CLK) signal of an input digital video signal, and generating an interrupt signal at the scaler if the mode changes; and selectively generating a first mute signal at a control part to mute the display device upon receipt of the interrupt signal from the scaler when the scaler determines a mode change of the digital video signal when the digital video signal is input and a second mute signal when an analog video signal is input to the control part and the control part determines a mode change of the analog video signal.

6. The method of claim 5, wherein the determining of whether the display mode has changed further comprises:

counting the CLK signal to calculate an H-total and a V-total; and generating the interrupt signal when a current H-total and a current V-total are different from a previous H-total and a previous V-total.

7. The method of claim 5, further comprising:

determining whether horizontal and vertical synchronization signals of an input analog signal are input, and accordingly generating the mute signal if a change in modes of the display device is detected.

8. A video muting device for removing transient phenomena and noise, comprising:

a scaler to perform scaling control of input video signals, including an input analog video signal and an input digital video signal, for display on a display system, to count a clock (CLK) signal of the input digital video signal to calculate horizontal-total (H-total) and vertical-total (V-total), indicating whether a mode of the input digital video signal changes, and to generate an interrupt signal if the mode changes; and a control part to determine whether horizontal and vertical synchronization signals of the input analog video signal are input, and to selectively generate a first mute signal when a mode changes of the digital video signal is detected the mode change of the digital video signal being indicated to the control part by the scaler generated interrupt signal and a second mute signal when the analog video signal is input to the control part and the control part determines a mode change of the analog video signal.

9. The video muting device of claim 8, wherein the change of mode of the input digital video signal is determined when a current H-total and/or V-total is determined to be different from a previous H-total and/or V-total.

10. A display system, comprising:

the video muting device of claim 8;

a parallel-serial conversion part to convert a video signal output from the scaler into a serial signal;

a display panel to externally display the converted video signal;

a lamp control part to control lighting of a fluorescent lamp of the display panel; and a power supply part to supply driving power to the display device, wherein the mute signal controls driving of the parallel-serial conversion part, the display panel, and/or the lamp control part.

11. A video muting method for removing transient phenomena and noise, comprising:

performing scaling in a scaler control of input video signals, including an input analog video signal and an input digital video signal, for display on in display system, including counting a clock (CLK) signal of the input digital video signal to calculate horizontal-total (H-total) and vertical-total (V-total), and generating in the scaler an interrupt signal indicating whether a mode of the input digital video signal changes;

determining whether horizontal and vertical synchronization signals of the input analog video signal are input, in a control part separate from the scaler; and selectively generating a first mute signal when a mode changes of the digital video signal is detected the mode change of the digital video signal being indicated to the control part by the scaler generated interrupt signal and generating a second mute signal when the analog video signal is input to the control part and the control part determines a mode change of the analog video signal.

12. The video muting method of claim 11, wherein the change of mode of the input digital video signal is determined when a current H-total and/or V-total is determined to be different from a previous H-total and/or V-total.

13. A display method, comprising:

the video muting method of claim 11;

parallel-serial converting a video signal output from the scaler into a serial signal;

displaying the converted video signal on a display;

illumination controlling to control an illumination of the display I; and wherein the mute signal controls operation of the parallel-serial converting, the displaying of the converted video on the display, and/or the illumination controlling.

14. A display system, comprising:

a scaler to perform scaling control of an input video signal, the scaler outputting an interrupt signal based upon a determination, according to a clock (CLK) signal of an input digital video signal, whether a mode of a display device changes, and generating an interrupt signal when the mode of the input digital video changes;

a display to display a scaler controlled output video signal;

a control part to selectively generate a first mute signal controlling illumination of the display based upon the generated interrupt signal received from the scaler when a mode change of the digital video signal is detected and a second mute signal when an analog video signal is input to the control part and a mode change of the input analog video signal is detected.

* * * * *

UNITED STATES PATENT AND TRADEMARK OFFICE

CERTIFICATE OF CORRECTION

PATENT NO. : 7,755,568 B2
APPLICATION NO. : 11/033254
DATED : July 13, 2010
INVENTOR(S) : Chul-ho You It is certified that error appears in the above-identified patent and that said Letters Patent is hereby corrected as shown below:

Column 7, Line 34 delete "detected" and insert -- detected, --, therefor

Column 8, Line 18 delete "detected" and insert -- detected, --, therefor

Signed and Sealed this

Sixteenth Day of November, 2010

David J. Kappos

David J. Kappos
*Director of the United States Patent and Trademark Office*